US010728660B2

(12) United States Patent
Napoli et al.

(10) Patent No.: US 10,728,660 B2
(45) Date of Patent: Jul. 28, 2020

(54) METHODS AND APPARATUS FOR TRANSDUCER EXCURSION PREDICTION

(71) Applicant: Cirrus Logic International Semiconductor Ltd., Edinburgh (GB)

(72) Inventors: Roberto Napoli, Milan (IT); Jason William Lawrence, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/161,410

(22) Filed: Oct. 16, 2018

(65) Prior Publication Data

US 2019/0116419 A1 Apr. 18, 2019

Related U.S. Application Data

(60) Provisional application No. 62/572,807, filed on Oct. 16, 2017.

(51) Int. Cl.
*H04R 3/00* (2006.01)

(52) U.S. Cl.
CPC ..... *H04R 3/007* (2013.01); *H04R 3/00* (2013.01)

(58) Field of Classification Search
CPC .. H04R 3/007; H04R 2499/11; H04R 29/001; H04R 25/305; H04R 25/356; H04R 3/00; H04R 29/00; H04R 29/003
USPC ..... 381/55, 58–59, 77, 81–82
See application file for complete search history.

(56) References Cited

U.S. PATENT DOCUMENTS

2012/0039478 A1* 2/2012 Yoshioka ..... G10L 25/90 381/56
2012/0179456 A1* 7/2012 Ryu ..... H04R 3/007 704/200.1
2012/0207314 A1* 8/2012 Gautama ..... H04R 3/002 381/55
2015/0181318 A1* 6/2015 Gautama ..... H04R 1/00 381/59
2016/0157035 A1* 6/2016 Russell ..... H04R 7/16 381/405
2018/0103313 A1* 4/2018 Doy ..... H04R 1/2834

* cited by examiner

*Primary Examiner* — Disler Paul
(74) *Attorney, Agent, or Firm* — Jackson Walker L.L.P.

(57) ABSTRACT

Embodiments described herein provide methods and apparatus for predicting the excursion of a transducer. The method comprises determining whether an input signal to the transducer is a periodic signal; and responsive to determining that the input signal is a periodic signal, calculating the predicted excursion based on a direct current ("DC") offset associated with the transducer.

28 Claims, 6 Drawing Sheets

METHODS AND APPARATUS FOR TRANSDUCER EXCURSION PREDICTION

TECHNICAL FIELD

Embodiments described herein relate to methods and apparatus for predicting the excursion of a transducer. In particular, embodiments described herein utilize knowledge of whether an input signal comprises a periodic signal to determine whether large excursion of a transducer will occur.

BACKGROUND

Direct current (DC) Offset is a phenomenon that causes the excursion of the diaphragm (or cone) of a transducer (and of micro-speakers in particular) to manifest an asymmetric behaviour (the diaphragm moves more in one direction than the other). This DC offset may be caused, for example, by one or more of following three example factors:

1) As a result of problems in the mechanical design of the transducer or in its manufacturing process, the diaphragm of the transducer may not be centred with respect to the magnet and, therefore, even at rest, the diaphragm may be in a position that is not central to the magnets. This non-central position may lead to asymmetrical movements of the diaphragm regardless of the amplitude and/or frequency of the driving signal.
2) Differences in the air-load in the front and back cavity of the transducer may result in asymmetries in the movement of the diaphragm as the diaphragm may face different air resistances when moving in one direction compared to the other. This result may be caused by a poor or constrained acoustical design, or by flows in the manufacturing process of the transducer as well as any external factors (e.g. presence of water or a finger obstructing a front cavity of the transducer).
3) The typical asymmetry in the nonlinear characteristics of the electrical and mechanical parameters of the transducer also contribute to the DC offset. In particular, such nonlinear characteristics are the nonlinear behaviour of the force factor, the stiffness and the inductance of the transducer (respectively BI(x), Cms (x) and Le(x)). These nonlinearities may become particularly evident when the transducer is driven with large signals (that therefore can cause more excursion).

Various studies focus on the causes and effects of DC offset, which is a complex phenomenon to analyse and model in detail. The factors listed above can all manifest in a single transducer with results that are difficult to accurately predict.

From the point of view of transducer protection applications, the presence of DC offset can be a problem if the transducer is driven close to an excursion limit of the transducer without considering that the diaphragm could be exceeding the safe excursion region when it moves in one direction due to the DC offset.

In typical transducer protection applications for the consumer electronics industry, the micro-transducer design and manufacturing process are fairly well controlled, so the main cause of DC offset in normal use cases that require protection is the third factor listed above. The focus of the embodiments described herein is therefore to address DC offset that manifests with large signals and that may not be constant.

FIG. 1 illustrates the DC offset profiles of three example speakers or transducers of the same type, model or design.

As can be seen from this figure, the DC offset profile of the three speakers, while not identical, is of a similar shape. In particular, in all three profiles, a maximum DC offset is reached at around the same frequency, which in this example is around 1100 Hz. This frequency at which the maximum DC offset is reached is often the resonance frequency for a particular type of transducer. The maximum values of the DC offset are also the same/similar, in this example around −0.09 mm. This nonlinear profile may therefore be used to estimate the direct current (DC) offset caused by the third factor (problem 3 above) for a particular speaker/transducer type.

FIG. 2 illustrates measurements of DC offset for three different transducer types, models or designs. In this example, Speaker A is illustrated by line 201, Speaker B is illustrated by line 202 and Speaker C is illustrated by line 203.

As seen from FIG. 2, transducers of different types may have different DC offset profiles. Therefore, while it may be possible to draw conclusions across all transducer samples of a certain transducer type, the same results may not be valid for different transducer types.

A transducer protection system takes into account the effect of DC offset when limiting the excursion of the transducer. An accurate and reliable DC offset prediction model is however difficult to design and use in real applications because of the complexity of the phenomenon. A good nonlinear model of the speaker or transducer may be able to estimate the amount of DC offset, but it needs to either model online or know in advance the nonlinear behaviour of the transducer parameters. It may not be possible to run a model on resource-constrained devices because of limitations in Million Instructions per Second ("MIPS")/memory, and/or because running the characterization process required to gather the parameters and data needed by the nonlinear model to be robust across a wide distribution of speakers or transducers could be impractical in certain applications.

SUMMARY

According to embodiments described herein there is provided a method of determining a predicted excursion of a transducer. The method comprises determining whether an input signal to the transducer is a periodic signal; and responsive to determining that the input signal is a periodic signal, calculating the predicted excursion based on a direct current ("DC") offset associated with the transducer.

According to some embodiments, there is provided an excursion prediction block for determining a predicted excursion of a transducer. The excursion predication block comprises processing circuitry configured to: determine whether an input signal to the transducer is a periodic signal; and responsive to determining that the input signal is a periodic signal, calculate the predicted excursion based on a direct current ("DC") offset associated with the transducer.

BRIEF DESCRIPTION OF THE DRAWINGS

For a better understanding of the present invention, and to show how it may be put into effect, reference will now be made, by way of example only, to the accompanying drawings, in which.

DESCRIPTION

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

Embodiments described herein make use of the observation that DC offset may be maximized in certain conditions, for example, when periodic signals are input into the transducer, especially at certain frequencies. Therefore, instead of trying to detect the presence and amount of DC offset itself, which is a difficult and expensive process, the signals, e.g. periodic signals, that are more likely to cause DC offset are detected.

Signals that are more likely to result in DC offset may be described as periodic signals. It will be appreciated that the design of what is categorized as periodic may be defined by the designer of a particular system, for example, depending on how a particular transducer is expected to react or respond to different signals. For example, for some transducers a signal comprising only a small number of repeated period of signal may result in a DC offset. The system may therefore be designed to classify a signal as periodic based on only a small number of periods. Equally, for some transducers, the DC offset may only be evident when the number of periods for which the input signal remains periodic is larger, and the system may be set up accordingly.

Figure 3:
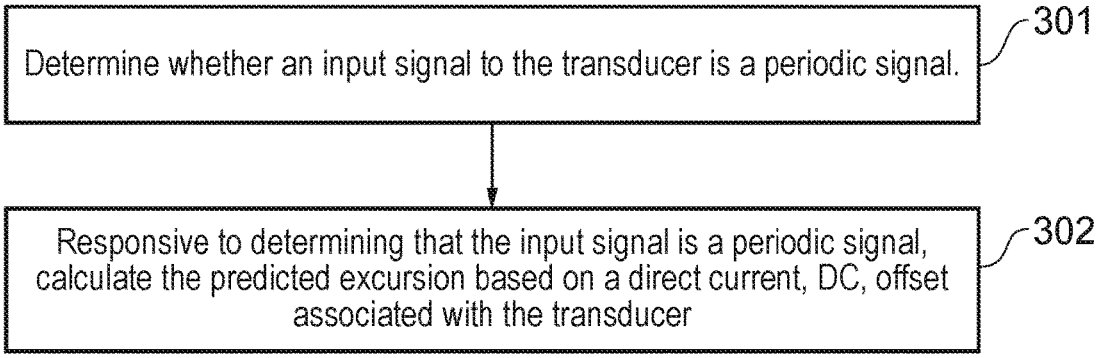
FIG. 3 is an example flow chart that shows a method of determining a predicted excursion of a transducer in accordance with embodiments described herein.

FIG. 3 illustrates a method of determining a predicted excursion of a transducer in accordance with embodiments described herein.

In step 301, the method comprises determining whether an input signal to the transducer is a periodic signal.

In step 302, the method comprises, responsive to determining that the input signal is a periodic signal, calculating the predicted excursion based on a direct current ("DC") offset associated with the transducer.

Figure 2:
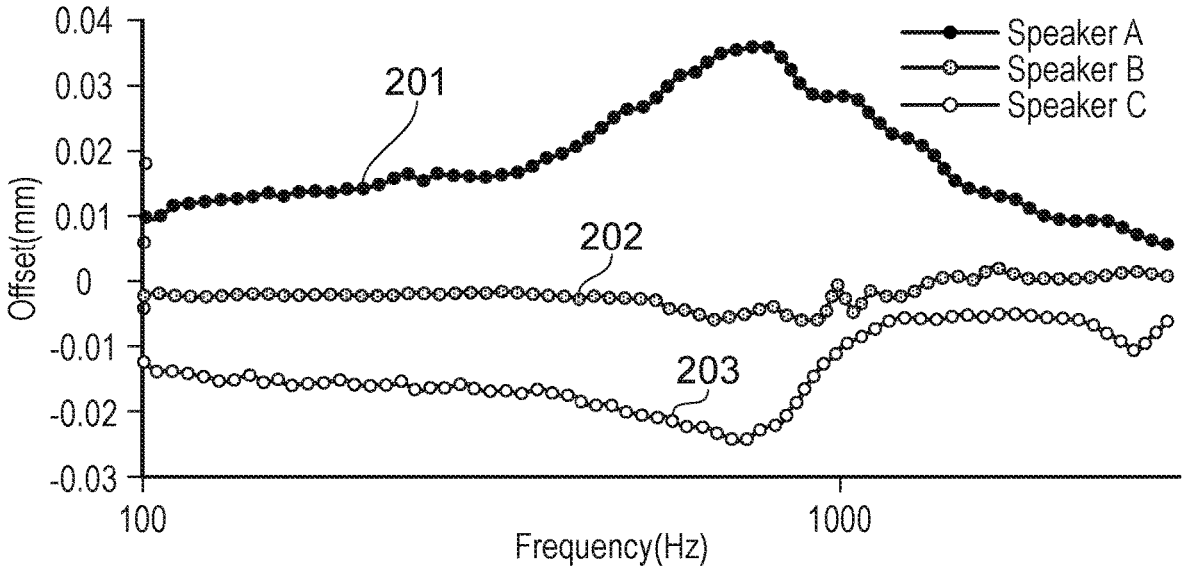
FIG. 2 shows an example plot of measurements of DC offset for three different example transducer types.

The predicted excursion may, therefore, be based on a model excursion expected to be caused by the input signal, and responsive to the input signal being a periodic signal, the model excursion may be adjusted by a DC offset associated with the transducer. For example, there may be different DC offsets associated with different transducer types, as illustrated in FIG. 2. The predicted excursion may then be used as an input for an excursion protection algorithm for the transducer.

A pre-defined level of DC offset may therefore result from a process in which one or more transducers of the same type are characterized, and measurement data is further processed in such a way that the results may be associated to the excursion DC offset value of a transducer type.

Figure 4:
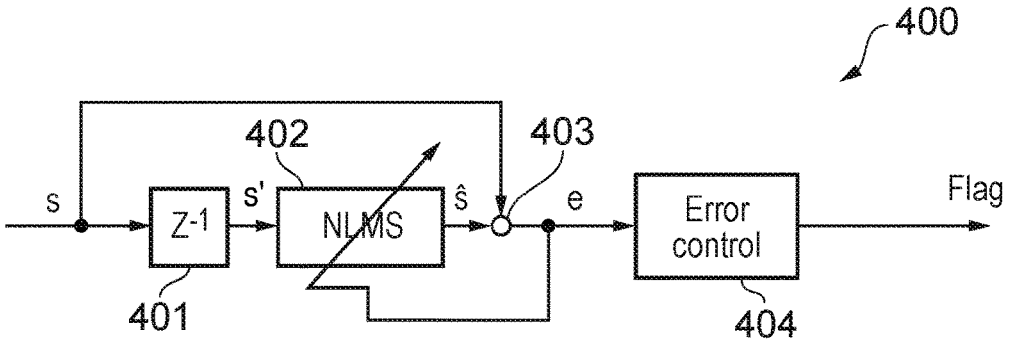
FIG. 4 is an example block diagram showing a periodic signal detector in accordance with embodiments described herein.

FIG. 4 illustrates an example of a periodic signal detector 400 according to some embodiments. The periodic signal detector 400 may be configured to perform step 301 of FIG. 3.

It will be appreciated that the detection of periodic signals may be performed in various ways, and the examples provided herein should not limit the scope of the embodiments described herein.

In the example illustrated in FIG. 4, a Prediction Normalized Least Mean Squares (NLMS) system identification approach is used. The input signal s is delayed by k samples in delay block 401, where k is an integer value. The delayed input signal, s', is then input into an adaptive filter 402 configured to determine a predicted value for a current sample of the input signal. In other words, the adaptive filter may be configured to predict k samples ahead of the signal it receives. This predicted value may be determined based on N previous samples which may be stored in a buffer in the adaptive filter 402.

The output of the adaptive filter 402 may be the predicted value for the current sample ŝ. The predicted value ŝ may be compared to the current value of the input signal s. In this example, the predicted value ŝ may be subtracted from the current value s by subtraction block 403 to determine an error signal, e. The error signal may be used by the adaptive filter 402 to try to adjust the prediction in order to minimize the magnitude of the error signal e. For example, the adaptive filter 402 may adjust weights applied to the plurality of previous samples based on the error signal.

For example, at sample n, the delayed signal s' input into the adaptive filter 402 is a buffer of samples defined as:

$$s'(n)=[s(n),s(n-1),s(n-2), \ldots s(n-L+1)]^T,$$

where L is the number of filter taps. The number of previous samples, N, may be selected as equal to L.

The adaptive filter (402) h(n) may be defined as:

$$h(n)=[h_0(n),h_1(n),h_2(n),h_{L-1}(n)]^T.$$

The predicted value ŝ may then be calculated as:

$$\hat{s}(n)=h^H(n)\cdot s'(n)$$

where $^H$ indicates the Hermitian transpose or conjugate transpose.

The error signal e may then be calculated as:

$$e(n)=s(n)-\hat{s}(n).$$

The filter taps of the adaptive filter may then be updated according to:

$$h(n+1)=h(n)+\mu\cdot e(n)\cdot s'(n),$$

where μ may be set to control how aggressively the filter updates.

The aim of the adaptive filter 402 may therefore be to produce a predicted value ŝ such that ŝ=s. This is may only be possible in examples where the input signal is a periodic signal.

In this example, an error control block 404 monitors the error signal e. Responsive to the comparison meeting a criterion, the error control block 404 may determine that the input signal s is periodic. For example, the error control block 404 may use some control logic to determine whether certain conditions are met and, therefore, whether the input signal s may be considered periodic or not. In this example, a flag is output to communicate whether the input signal is considered periodic to a DC offset compensation block, which will be described later with reference to FIGS. 7 and 8.

For example, the criterion may comprise a threshold value, and comparison may be considered to meet the criterion if a magnitude of the error signal is less than the threshold value.

In some examples, the criterion comprises a threshold value, and wherein the comparison meets the criterion if the error signal remains less than the threshold value for a predetermined period of time.

When the error control block determines that the criterion is met, the flag may be set to indicate that the input signal is considered to be periodic.

Figure 5:
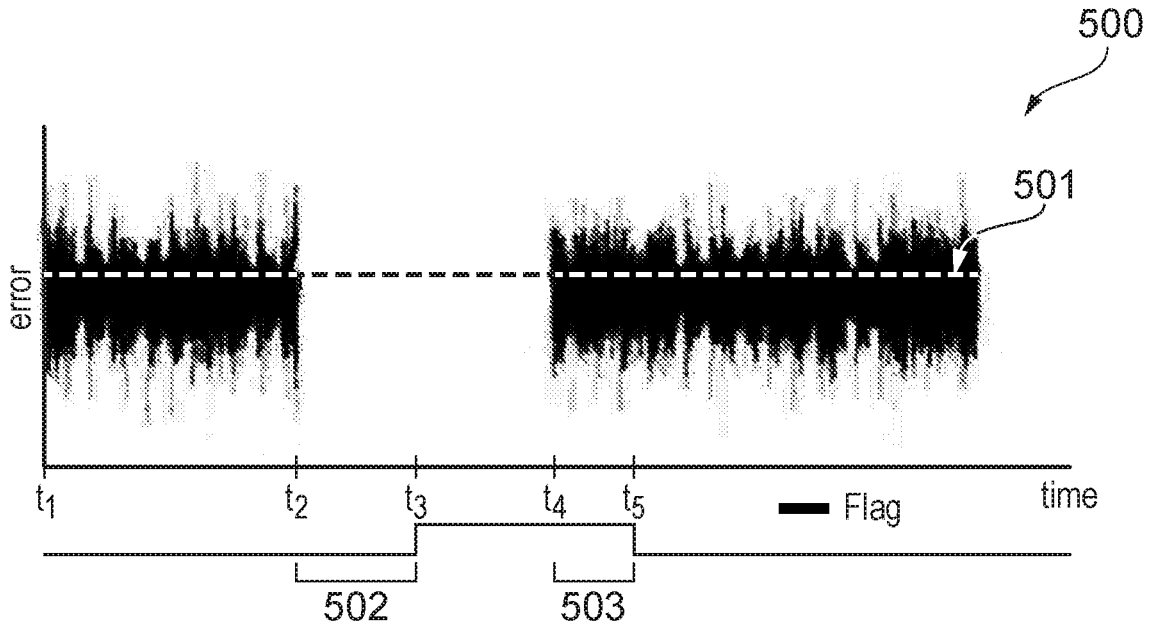
FIG. 5 shows an example plot illustrating the behaviour of the periodic signal detector illustrated in FIG. 4 in accordance with embodiments described herein.

FIG. 5 illustrates an example of the behaviour of the periodic signal detector 400 when, firstly, a non-periodic signal, for example a broadband (noise) signal, is input into the periodic signal detector, and then a periodic signal, for example a single tone frequency, is input into the periodic signal detector 400. The graph 500 in FIG. 5 plots the value of the error signal e as a function of time.

The error signal e remains large when a non-periodic input signal is provided to the periodic signal detector 400 between time t1 and t2. However, when the input signal changes to a periodic signal at time t2, the error signal e becomes small, for example below the threshold value indicated by line 501. As previously mentioned the error control block 404 may have a mechanism with hysteresis to keep the output flag stable and avoid false triggers or fast switching.

For example, as illustrated in FIG. 5, when the error signal e drops below the threshold value 501 at time t2, the error control block 403 waits a wait time 502 in which the error signal e remains below the threshold before indicating at time t3 that the input signal is a periodic signal in the output flag. Equivalently, when the error signal e becomes higher than the threshold value 501 at time t4 (when the input signal is switched back to a non-periodic signal), the error control block 403 waits a second wait time 503 in which the error signal e remains above the threshold 501 before indicting at time t5 that the input signal is a non-periodic signal in the output flag.

In some examples, periodic signals may be detected by analysing a crest factor of the input signal. Broadband signals, which may typically be considered to be non-periodic signals, may have a higher crest factor that may change frequently when analysed over a short time window.

Figure 6:
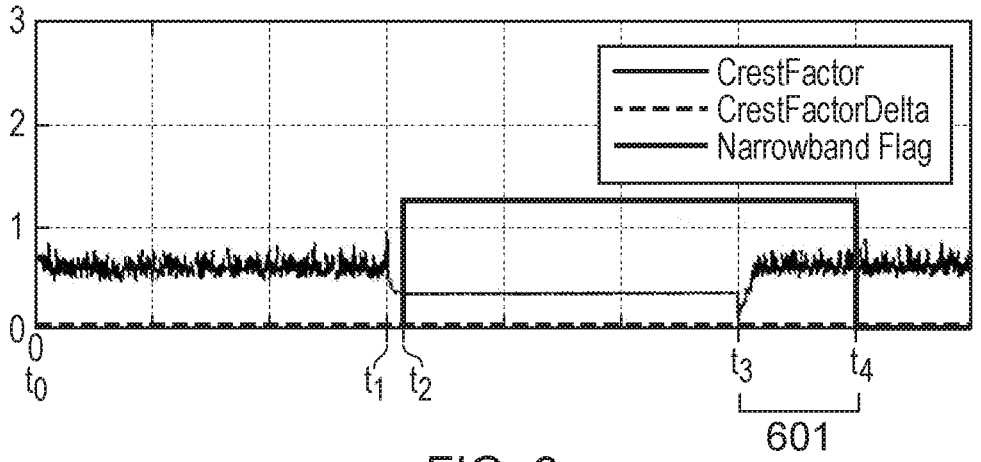
FIG. 6 shows an example plot of a crest factor of an input signal when the input signal is changed from a non-periodic signal to a periodic signal.

FIG. 6 illustrates an example of a crest factor of an input signal when the input signal is changed from a non-periodic to a periodic signal.

In this example, between times t0 and t1, the input signal comprises a non-periodic signal, and the crest factor of the signal varies. This variation of the crest factor, along with the value of the crest factor, may indicate that the input signal is non-periodic. At time t1, the input signal is changed to a periodic signal. The crest factor at t1 drops slightly and becomes constant, and this constant crest factor may be considered indicative of the periodic nature of the input signal. A periodic signal detector implementing this embodiment may output a flag indicating that the signal is periodic when the crest factor becomes constant, as illustrated at time t2. This time t2 may be slightly after the input signal is changed to a periodic signal. At time t3, the input signal is switched back to a non-periodic signal. In this example, the periodic signal detector waits a wait time 601 during which the crest factor remains non-constant before indicating that the input signal is non-periodic at time t4.

The magnitude and/or the variation of the crest factor may be used as an indicator of the type of input signal (e.g. periodic or non-periodic), and the flag may be set using a control logic similar to the one shown for the Prediction NLMS embodiment.

The periodic signal detector embodiments described above are based on time-domain algorithms. In some embodiments, frequency-domain algorithms may be used to determine whether the input signal is considered periodic. For example, the sparsity of the spectrum in an input signal may indicate whether the input signal is periodic content.

A combination of different detection techniques (e.g. Prediction NLMS, Crest Factor Analysis and/or frequency domain algorithms) may also be used to improve the accuracy and robustness of the Periodic Signal Detection.

In step 302 of FIG. 3, the predicted excursion is determined based on a DC offset associated with the transducer. The DC offset associated with the transducer may be considered a correction factor, based on a pre-characterized level of DC Offset, which may be applied to a model excursion to account for the nonlinear behaviour of the speaker or transducer when periodic signals are being played. In other words, when a periodic signal detector indicates that the input signal is a periodic signal, a correction factor may be included in the predicted excursion of the transducer to account for an expected DC offset.

Figure 1:
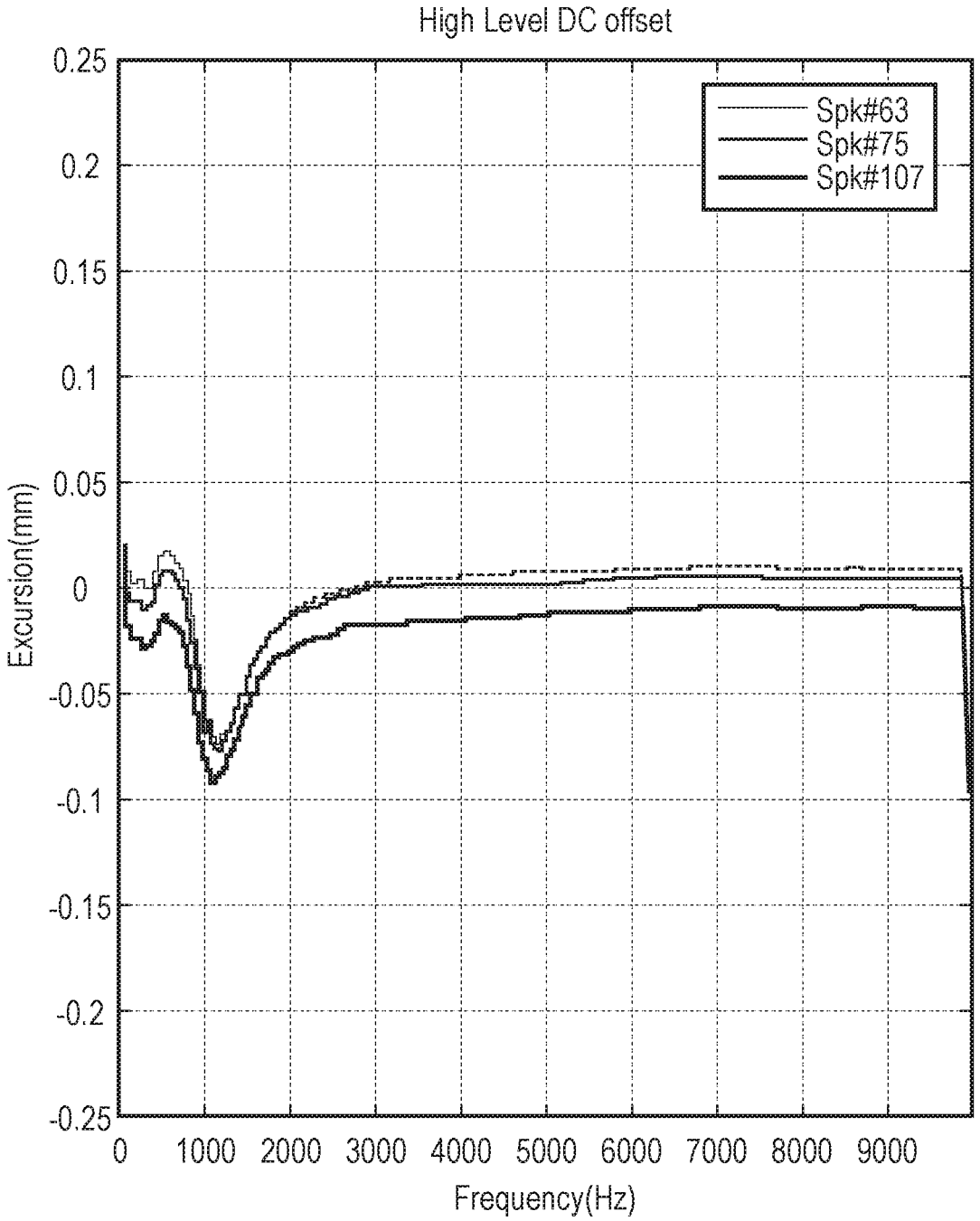
FIG. 1 shows an example plot of the direct current (DC) offset profiles of three speakers of the same type.

With reference to the measurements illustrated in FIG. 1 and FIG. 2, for each type of transducer, the DC offset is measured and a maximum DC offset is calculated that may affect the transducer. The maximum DC offset may be calculated based on a DC offset measurement across all frequencies and across multiple transducer samples. A predefined DCOffset_max term for a particular transducer type may therefore be derived through simple characterization procedures.

Figure 7:
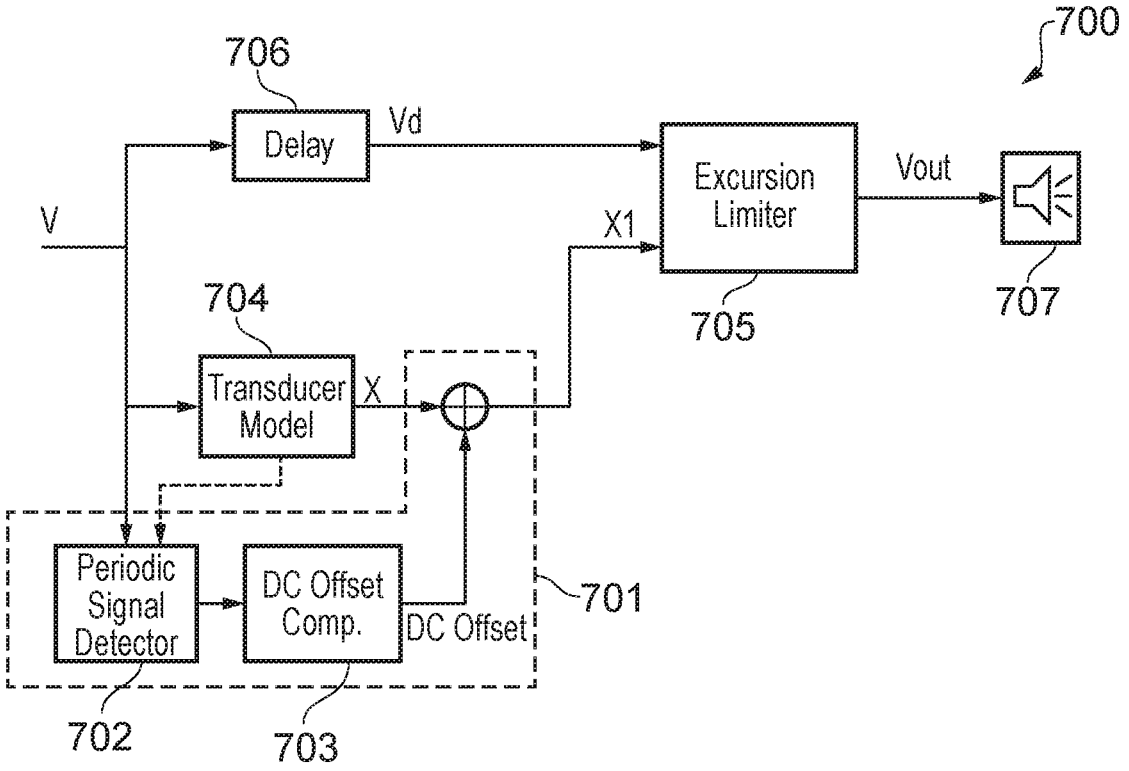
FIG. 7 is an example block diagram showing a system comprising an excursion prediction block in accordance with embodiments described herein.

FIG. 7 illustrates a system 700 comprising an excursion prediction block 701 according to some embodiments.

In this example, the excursion prediction block 701 comprises a periodic signal detector 702 which may be configured as described above. The excursion prediction block 701 also comprises a DC Offset Compensation ("DC Offset Comp") block 703.

The DC Offset compensation block 703 may be configured to perform step 302 of FIG. 3. In some examples, responsive to receiving an indication from the periodic signal detector 702 that the input signal V comprises a periodic signal, the DC Offset compensation block 703 may be configured to output a DC Offset associated with the transducer 707. The DC Offset associated with the transducer 707 may be added to a model excursion X output by a transducer model 704 to result in the predicted excursion X1. The transducer model may be configured to estimate the excursion of the transducer based on the input signal V. The excursion prediction block may therefore be configured to receive a model excursion of the transducer; and responsive to determining that the input signal is a periodic signal, may calculate the predicted excursion by increasing the model excursion by the DC offset associated with the transducer.

In some examples, the DC Offset associated with the transducer 707 comprises a maximum DC offset of the transducer 707. In this example, by adding the maximum DC Offset of the transducer to the model excursion X responsive to the input signal V being indicated as a periodic signal, the excursion prediction block 701 ensures that an excursion limitation block ("Excursion Limiter") 705 receives a predicted excursion X1 that accounts for the possibility of the maximum DC Offset that the periodic signal could cause. As the excursion limitation block 705 is configured to limit the audio signal to ensure that the excursion remains below a predetermined excursion threshold, by including the maximum DC Offset in the predicted excursion the excursion prediction block 701 ensures that the limitation applied to the input signal V in the excursion limitation block 705 is high enough to avoid any damage to the transducer 707.

In this example, the system 700 comprises a delay block 706 configured to delay the input signal V before inputting it into the excursion limitation block 705 to allow the control system to reduce the inertia of the transducer 707 before it reaches the excursion limit.

The predicted excursion X1 and the delayed audio signal Vd are input into the excursion limitation block 705 which is configured to, based on a predefined excursion threshold, reduce Vd in a way that guarantees that Vout input into the transducer will not cause over-excursion when it reaches the transducer 707 (in some examples, this limiting may take into account any gain applied by an amplifier in the signal path between the excursion limitation block 705 and the transducer).

Figure 8A:
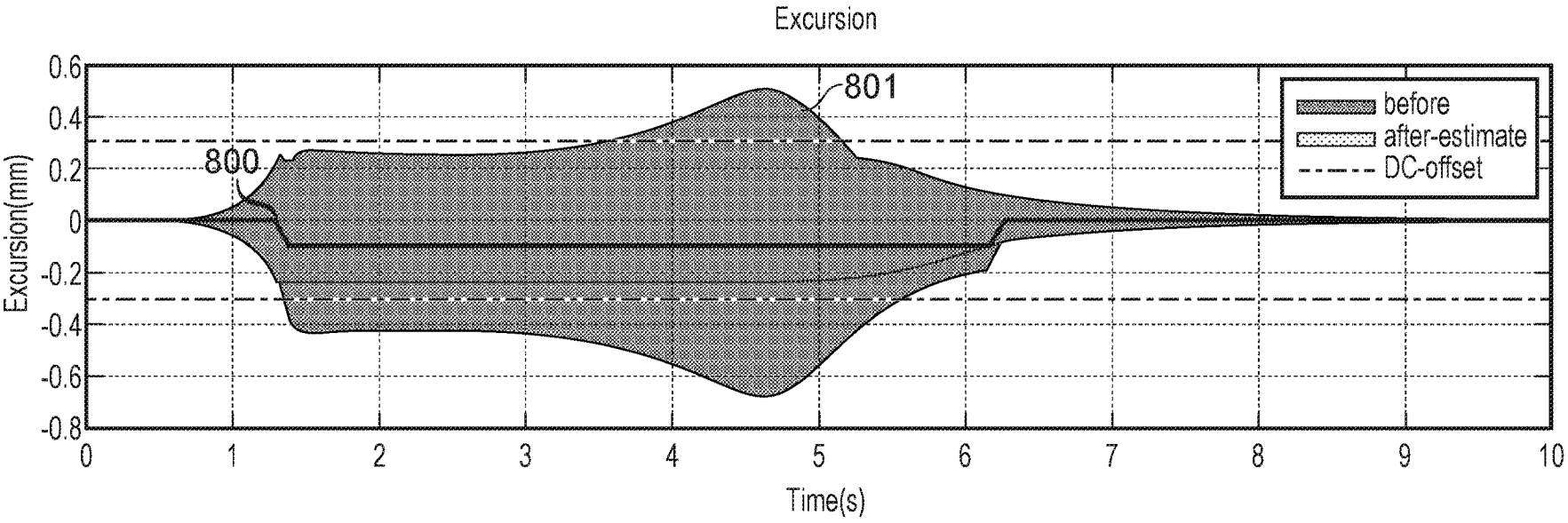
FIGS. 8*a* and 8*b* show example plots of the excursion of a transducer in response to an input chirp signal.

FIG. 8*a* illustrates an example of the excursion of a transducer in response to an input chirp signal. The chirp signal may be considered to comprise a periodic signal. As seen, the excursion of the transducer is larger in the negative direction than in the positive direction. This larger negative direction is due to DC offset caused by the signal being periodic.

With reference to the measurements illustrated in FIG. 1, the maximum DC Offset of the transducer, DCOffset_max, is set to −0.09 mm as this amount is the worst case DC offset observed on several transducer samples across all frequencies. However, it will be appreciated that the maximum DC Offset may be associated with a particular transducer, or determined/set using any other suitable method.

In this example, when the periodic signal detector 702 determines the presence of a periodic signal, the DC Offset Compensation stage updates the DC Offset associated with the transducer, indicated by line 800, that ramps from zero (0) mm to −0.09 mm. The ramp time may be a parameter that may be defined based on the transducer type or the value of maximum DC offset. In other words, responsive to determining that the input signal has changed from a non-periodic signal to a periodic signal, the DC offset compensation block 703 increases the DC offset associated with the transducer from zero to a maximum DC offset associated with the transducer over a first predetermined time period.

In this example, once the DC Offset associated with the transducer reaches DCOffset_max, it remains constant for as long as the periodic signal detector indicates that the input signal is periodic. When the Periodic Signal Detector flag is removed (e.g. because the signal is no longer periodic), the DC Offset may be ramped back to zero (0) mm with a ramp down time that may vary. In other words, responsive to determining that the input signal has changed from a periodic signal to a non-periodic signal, the DC offset compensation block 703 decreases the DC offset associated with the transducer from the maximum DC-offset to zero over a second predetermined time period. In other words, responsive to determining that the input signal is a non-periodic signal, the DC offset compensation block 703 may be configured to set the predicted excursion as the model excursion.

The DC offset compensation may also be activated based on the level of model excursion X. For example, if the model excursion X is small, there is little risk of damage to the transducer. In examples where the model excursion X is small therefore, the DC offset compensation may be disabled even if the signal is periodic. In other words, the periodic signal detector 702 may be configured to receive the model excursion X and responsive to the model excursion X being below a predetermined threshold may set the DC offset associated with the transducer to zero.

The line 801 in FIG. 8*a* illustrates the predicted excursion X1 after the DC Offset associated with the transducer is applied. While at the start of the signal, the predicted excursion X1 is symmetrical because the DC Offset is zero (0) mm, when the DC Offset is increased to DCOffset_max, the waveform of the predicted excursion is asymmetrical and shows more excursion in the negative direction compared to the positive, which is what it should be expected based on the measurements of FIG. 1.

Figure 8B:
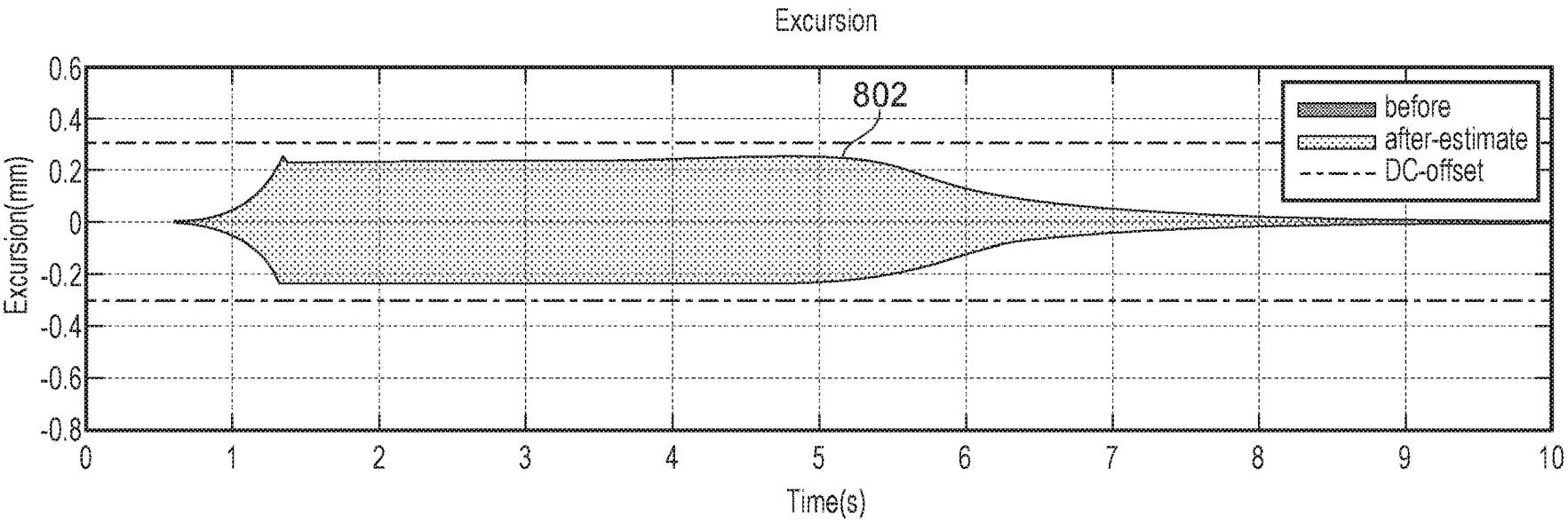

In contrast, FIG. 8*b* illustrates the estimated excursion of the output signal Vout after excursion protection is applied by the excursion limitation block 705 where no DC offset is accounted for. In other words, if output signal Vout is taken out and passed again through the transducer model 704, the result would be line 802. However, this estimated excursion of the output signal Vout is not accounting for the DC offset which would be expected for this type of transducer 707. The excursion in one direction would therefore likely be higher than illustrated and the transducer may be damaged by over excursion.

In some embodiments the DC Offset associated with the transducer may be frequency-dependent. For example, the DC offset associated with the transducer may be divided in frequency regions and a look-up table may be created with the maximum DC offset across transducer samples for each frequency region. In this way, instead of applying the maximum DC offset value regardless of frequency, it is possible to apply a different fixed DC offset correction factor based on the frequency (or a main frequency) of the periodic input signal. This embodiment requires the Periodic Signal Detector to also provide data on the frequency of the periodicity of the input signal, when the input signal is periodic. The frequency-domain detection method described in the Periodic Signal Detection section may be extended to provide this additional functionality.

In some examples therefore, the excursion predication block may, responsive to determining that the input signal is a periodic signal, determine a frequency of the input signal and set the DC offset based on the frequency of the input signal.

Embodiments described herein provide a conservative approach to predicting the excursion of a transducer as they apply a worst case DC offset correction based on a-priori information regarding the behaviour of the transducer. The over-attenuation drawback that may result by applying the DCOffset_max for periodic signals may be compensated by the benefit of not applying unnecessary DC offset during non-periodic (for example broadband content such as music) playback, which may be considered the most important use case in terms of loudness requirements. Moreover, as described, a frequency-dependent DC Offset Compensation scheme may be used to mitigate the risk of over-attenuation at the expense of additional complexity in the Periodic Signal Detector and in the processing of the DC offset measurements.

There is therefore provided methods and apparatus for determining a predicted excursion of a transducer. In particular embodiments described herein determine whether an input signal is a periodic signal and adjust the predicated excursion depending on whether the input signal is a periodic signal.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in the claim, "a" or "an" does not exclude a plurality, and a single feature or other unit may fulfil the functions of several units recited in the claims. Any reference numerals or labels in the claims shall not be construed so as to limit their scope. Terms such as amplify or gain include possible applying a scaling factor or less than unity to a signal.

It will of course be appreciated that various embodiments of the analog conditioning circuit as described above or various blocks or parts thereof may be co-integrated with other blocks or parts thereof or with other functions of a host device on an integrated circuit such as a Smart Codec.

The skilled person will thus recognize that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus, the code may comprise conventional program code or microcode or, for example code for setting up or controlling an ASIC or FPGA. The code may also comprise code for dynamically configuring re-configurable apparatus such as re-programmable logic gate arrays. Similarly, the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solution to problems that are described herein with regard to specific embodiments are not intended to be construed as a critical, required, or essential feature of element.

Further embodiments likewise, with the benefit of this disclosure, will be apparent to those having ordinary skill in the art, and such embodiments should be deemed as being encompasses herein.

The invention claimed is:

1. A method of determining a predicted excursion of a transducer, comprising:

determining whether an input signal to the transducer is a periodic signal; and responsive to determining that the input signal is a periodic signal, calculating the predicted excursion based on a direct current ("DC") offset associated with the transducer;

wherein the step of determining further comprises:

determining a predicted value for a current sample of the input signal;

comparing the predicted value to the current sample; and responsive to the comparison meeting a criterion, determining that the input signal is periodic.

2. The method of claim 1 further comprising:

receiving a model excursion of the transducer; and responsive to determining that the input signal is a periodic signal, calculating the predicted excursion by increasing the model excursion by the DC offset associated with the transducer.

3. The method of claim 2 further comprising:

responsive to determining that the input signal has changed from a non-periodic signal to a periodic signal, increasing the DC offset associated with the transducer from zero to a maximum DC offset associated with the transducer over a first predetermined time period.

4. The method as claimed in claim 2 further comprising, responsive to the model excursion being below a predetermined threshold, setting the DC offset associated with the transducer to zero.

5. The method of claim 1 wherein the DC offset further comprises a maximum DC offset of the transducer.

6. The method of claim 1 wherein the step of comparing further comprises calculating an error signal as a difference between the predicted value and the current sample.

7. The method of claim 6 wherein the criterion further comprises a threshold value, wherein the comparison meets the criterion if the error signal is less than the threshold value.

8. The method of claim 6 wherein the criterion further comprises a threshold value, and wherein the comparison meets the criterion if the error signal remains less than the threshold value for a predetermined period of time.

9. The method of claim 6 wherein the step of predicting the predicted value further comprises:

determining the predicted value based on a normalized least mean square of a plurality of previous samples of the input signal;

receiving the error signal; and adjusting weights applied to the plurality of previous samples based on the error signal.

10. The method of claim 1 wherein the step of determining whether the input signal to the transducer is a periodic signal further comprises determining at least one of the following: a level and a variation in a crest factor of the input signal.

11. The method of claim 1 wherein the step of determining whether the input signal to the transducer is a periodic signal further comprises determining a sparsity of the input signal.

12. The method of claim 11 further comprising:
responsive to determining that the input signal has changed from a periodic signal to a non-periodic signal, decreasing the DC offset associated with the transducer from the maximum DC-offset to zero over a second predetermined time period.

13. The method of claim 1 further comprising:
responsive to determining that the input signal is a non-periodic signal, setting the predicted excursion as a model excursion.

14. The method of claim 1 further comprising:
responsive to determining that the input signal is a periodic signal, determining a frequency of the input signal; and
setting the DC offset based on the frequency of the input signal.

15. A excursion prediction block for determining a predicted excursion of a transducer, the excursion prediction block comprising processing circuitry configured to:
determine whether an input signal to the transducer is a periodic signal; and
responsive to determining that the input signal is a periodic signal, calculate the predicted excursion based on a direct current ("DC") offset associated with the transducer
wherein the processing circuitry is further configured to determine whether the input signal is a periodic signal by:
determining a predicted value for a current sample of the input signal;
comparing the predicted value to the current sample; and
responsive to the comparison meeting a criterion, determining that the input signal is periodic.

16. The excursion prediction block of claim 15 wherein the processing circuitry is further configured to:
receive a model excursion of the transducer; and
responsive to determining that the input signal is a periodic signal, calculate the predicted excursion by increasing the model excursion by the DC offset associated with the transducer.

17. The excursion prediction block as claimed in claim 16 wherein the processing circuitry is further configured to, responsive to the model excursion being below a predetermined threshold, set the DC offset associated with the transducer to zero.

18. The excursion prediction block of claim 16 wherein the processing circuitry is further configured to:
responsive to determining that the input signal has changed from a non-periodic signal to a periodic signal, increase the DC offset associated with the transducer from zero to a maximum DC offset associated with the transducer over a first predetermined time period.

19. The excursion prediction block of claim 18 further comprising:
responsive to determining that the input signal has changed from a periodic signal to a non-periodic signal, decrease the DC offset associated with the transducer from the maximum DC-offset to zero over a second predetermined time period.

20. The excursion prediction block of claim 15 wherein the DC offset further comprises a maximum DC offset of the transducer.

21. The excursion prediction block of claim 15 wherein the processing circuitry is further configured to compare the predicted value to the current sample by calculating an error signal as a difference between the predicted value and the current sample.

22. The excursion prediction block of claim 21 wherein the criterion further comprises a threshold value, wherein the comparison meets the criterion if the error signal is less than the threshold value.

23. The excursion prediction block of claim 21 wherein the criterion further comprises a threshold value, and wherein the comparison meets the criterion if the error signal remains less than the threshold value for a predetermined period of time.

24. The excursion prediction block of claim 21 wherein the processing circuitry is further configured to predict the predicted value by:
determining the predicted value based on a normalized least mean square of a plurality of previous samples of the input signal;
receiving the error signal; and
adjusting weights applied to the plurality of previous samples based on the error signal.

25. The excursion prediction block of claim 15 wherein the processing circuitry is further configured to determine whether the input signal to the transducer is a periodic signal by determining at least one of the following: a level and a variation in a crest factor of the input signal.

26. The excursion prediction block of claim 15 wherein the processing circuitry is further configured to determine whether the input signal to the transducer is a periodic signal by determining a sparsity of the input signal.

27. The excursion prediction block of claim 15 wherein the processing circuitry is further configured to:
responsive to determining that the input signal is a non-periodic signal, set the predicted excursion as the model excursion.

28. The excursion prediction block of claim 15 wherein the processing circuitry is further configured to:
responsive to determining that the input signal is a periodic signal, determine a frequency of the input signal and set the DC offset based on the frequency of the input signal.

* * * * *